United States Patent [19]

Ohtsuki et al.

[11] Patent Number: 4,748,864

[45] Date of Patent: Jun. 7, 1988

[54] MARINE REVERSING GEAR ASSEMBLY

[75] Inventors: Kazuhiko Ohtsuki, Maitani; Gen Yoshii, Mukonoso-Honmachi; Toshiaki Okanishi, Tozaki-dori, all of Japan

[73] Assignee: Kanzaki Kokyukoki Mfg. Co., Ltd., Amagasaki, Japan

[21] Appl. No.: 60,646

[22] Filed: Jun. 11, 1987

[30] Foreign Application Priority Data

Jul. 11, 1986 [JP] Japan ..... 61-163482

[51] Int. Cl.[4] ..... F16H 3/14

[52] U.S. Cl. ..... 74/377; 74/378; 74/416

[58] Field of Search ..... 74/376, 377, 378, 379, 74/416, 361

[56] References Cited

U.S. PATENT DOCUMENTS

| | | | |
|---|---|---|---|
| 1,707,247 | 4/1929 | Berge | 74/416 |
| 2,423,886 | 7/1947 | Hindmarch | 74/378 |
| 2,924,985 | 2/1960 | Crankshaw | 74/378 |
| 3,570,319 | 3/1971 | Arnold | 74/361 |
| 3,803,934 | 4/1974 | Yokel | 74/361 |
| 4,188,833 | 2/1980 | Krauss . | |
| 4,278,156 | 7/1981 | Yano . | |
| 4,643,687 | 2/1987 | Yano et al. | 74/416 X |
| 4,679,673 | 7/1987 | Yamaoka et al. | 74/331 X |

FOREIGN PATENT DOCUMENTS

| | | | |
|---|---|---|---|
| 2358778 | 5/1974 | Fed. Rep. of Germany . | |
| 237248 | 11/1985 | Japan | 74/377 |
| 2169571 | 1/1986 | United Kingdom . | |

*Primary Examiner*—Leslie A. Braun
*Assistant Examiner*—James W. Innskeep

[57] ABSTRACT

A reversing gear assembly (13) for a marine angle drive comprises a horizontal input shaft (15), to be connected to a horizontally mounted engine (11) and an inclined output shaft (16) to be connected to the propeller shaft (12). Gear casing (14) includes an intermediate shaft (17) which extends parallel with the output shaft (16). The input shaft (16) fixedly mounts a cylindrical gear (22) which meshes with a forward drive conical gear (23) on the output shaft (16) and with a reverse drive cylindrical gear (25) on the intermediate shaft (17). Center of engagement between the cylindrical gears (22, 25) is located on the sole common perpendicular line of the input and intermediate shafts (15, 17). Reverse drive gear train further includes two meshing cylindrical gears (26, 24) on the intermediate and output shafts (17, 16). The gears (23, 24) on the output shaft (16) are selectively coupled to this shaft by clutch means (32).

The parallel arrangement of the output and intermediate shafts (16, 17) and the use of a single conical gear (23) contributes to reducing the manufacturing cost while permitting drive of propeller shaft in either direction with equal power.

4 Claims, 3 Drawing Sheets

MARINE REVERSING GEAR ASSEMBLY

FIELD OF THE INVENTION

This invention relates to a marine reversing gear assembly for use in boats such as pleasure boats including yachts and motor boats, and fishing boats.

More particularly, the present invention relates to a marine reversing gear assembly for use in boats and adapted to be incorporated between an engine, mounted at a stern portion of the hull so that its output end is directed towards the stern, and a propeller shaft arranged to extend backwardly and downwardly from the hull. Thus, the present invention relates to a reversing gear assembly for use in marine angle drive system.

DESCRIPTION OF PRIOR ART

A standard type of such angle drive system is constructed in such a manner that the whole of the propulsion unit from engine to propeller shaft through the reversing gear assembly is mounted in an attitude which is inclined backwardly and downwardly by an angle equal to the inclination angle to be given to the propeller shaft. In a boat having an angle drive system of this standard type, height of the engine compartment must be enlarged due to the inclined attitude of the engine so that the adjacent crew space is reduced correspondingly. Enlargement of crew space within the hull of a boat is very important and is always required. From this, there have been proposed some propulsion units of angle drive type in which, while the engine is mounted in a horizontal or nearly horizontal posture, the transmission path is bent at a portion, where the reversing gear assembly is located, so as to give the required backward and downward inclination to the transmission path.

U.S. Pat. Nos 3,570,319 and 4,188,833 disclose a prior art device in which conical gears are used for providing an inclination in the marine propulsion transmission path within a reversing gear casing. This prior art marine propulsion unit is economical, because a conical gear may be manufactured at a low cost by using a hobbing machine with the aid of a taper attachment for varying the distance between a hob and the center of a gear blank when the hob is moved across the gear blank so as to form the toothed profile. Such propulsion unit may be made a compact one, because it has a structure such that some of the gears employed in a reversing gear assembly for the standard type propulsion unit are replaced by conical gears or intermeshing conical and cylindrical gears without increasing the number of gears.

In the reversing gear assembly disclosed in each of the two U.S. patents set forth above, an intermediate shaft is arranged within a gear casing at a mid level between an input shaft arranged at a high level and an output shaft arranged at a low level. Forward drive is transmitted from the input shaft directly to the output shaft by a selective operation of a forward pressure fluid operated clutch of the multi-disc type on the input shaft, whereas reverse drive is transmitted from the input shaft via the intermediate shaft to the output shaft by a selective operation of a fluid pressure operated reverse clutch of the multi-disc type on the intermediate shaft. For attaining a transmission of power between two shafts which are inclined relative to each other, either a pair of intermeshing conical gears or intermeshing conical and cylindrical gears are used. For driving the output shaft and, therefore, a propeller shaft connected thereto in either direction with equal power, gear ratios of the forward direction gear train and reverse direction gear train arranged between the input shaft and output shaft are made equal to each other.

This marine reversing gear assembly is considered to be satisfactory, because it may be manufactured with a low cost and because the mechanism for providing a bend or inclination in the transmission path does not lengthen the whole of a marine propulsion unit. Such assembly still involves, however, the following problem.

When gear ratios of forward direction gear train and reverse direction gear train are to be made equal to each other, as described before, a certain limit is given to the relative distances between each two shafts of the input, intermediate and output shafts. From this limit, the gear assembly disclosed in each of the U.S. patents set forth before employs two conical gears.

Use of two conical gears is not preferred because a conical gear is still high in manufacturing cost in comparison with a cylindrical gear. A more serious problem resides in a fact that a conical gear requires a precise adjustment of backlash. Breaking of gear tooth edges will be caused when such backlash is too large, whereas a noise of a high frequency will be generated when the backlash is too small. Such backlach can be adjusted only by displacing a conical gear along its axis. This work is considerably difficult and, thus, it is preferred for saving manufacturing cost to reduce the number of conical gears to be used.

OBJECT

Accordingly, a primary object of the present invention is to provide a novel marine reversing gear assembly, for use in marine angle drive, which employs only one conical gear while still permitting to drive an inclined output shaft in either direction with equal power.

SUMMARY OF THE INVENTION

Figure 6:
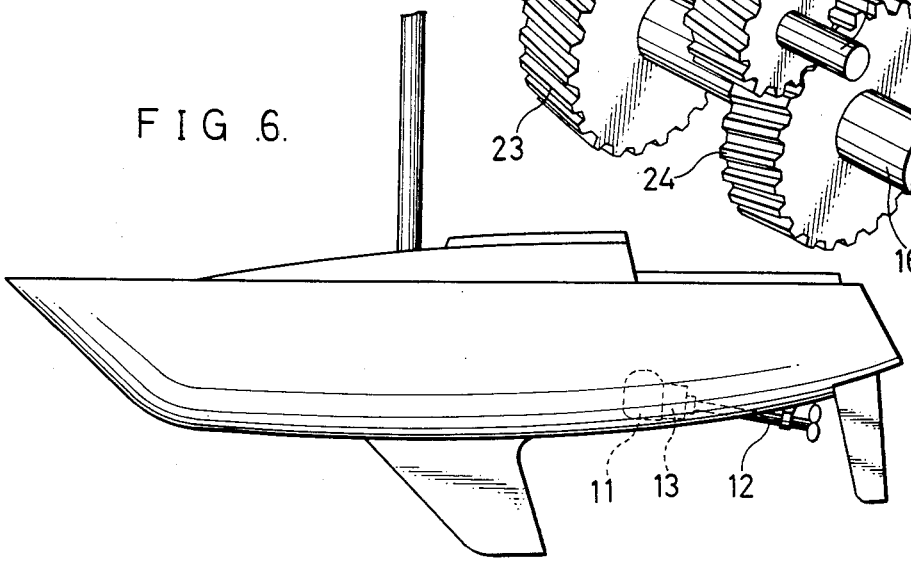
FIG. 6 is a schematic side view of which the a boat in the reversing gear assembly shown in FIG. 1 is employed.

The present invention relates to a marine reversing gear assembly 13 for use in boats, as shown in FIG. 6, between an engine 11, mounted in a stern portion of the hull of a boat with the output end of the engine towards the stern, and a propeller shaft 12 extending backwardly and downwardly from the hull.

As shown in FIGS. 1 to 5, the reversing gear assembly 13 according to the present invention comprises a gear casing 14 in which are arranged a horizontal input shaft 15 extending forwardly from the casing 14, an inclined output shaft 16 extending backwardly and downwardly from the casing 14, and an intermediate shaft 17 disposed in parallel with the output shaft 16.

The gear assembly further comprises a first cylindrical gear 22 fixedly mounted on the input shaft 15, axially spaced conical gear 23 and second cylindrical gear 24 rotatably mounted on the output shaft 16, and axially spaced corotatable third cylindrical gear 25 and fourth cylindrical gear 26 mounted on the intermediate shaft 17. The conical gear 23 on the inclined output shaft 16 meshes with the first cylindrical gear 22 on the horizontal input shaft 15, whereas second and fourth cylindrical gears 24 and 26 on the in-parallel disposed two inclined shafts 16 and 17 mesh with each other. The third cylindrical gear 25 on the inclined intermediate shaft 17 meshes with the first cylindrical gear 22 on the horizontal input shaft 15 in a fashion such that a center of engagement between these gears 22 and 25 is located substantially on a common perpendicular line of the input and intermediate shafts 15 and 17.

Figure 1:
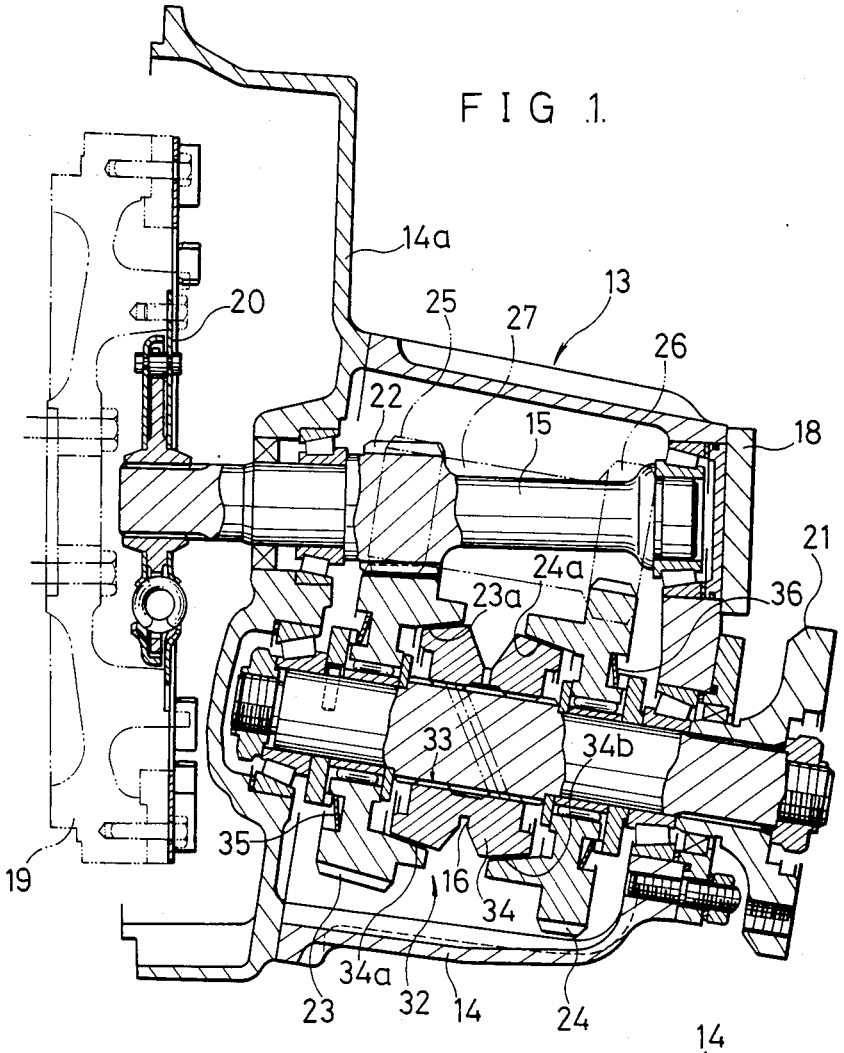
FIG. 1 is a sectional side view of an embodiment of the marine reversing gear assembly according to the present invention.

The gear assembly 13 further includes a clutch means 32 which is disposed on the output shaft 16 and between the conical gear 23 and second cylindrical gear 24 for coupling one of these gears selectively to the output shaft 16, as shown in FIG. 1.

Figure 5:
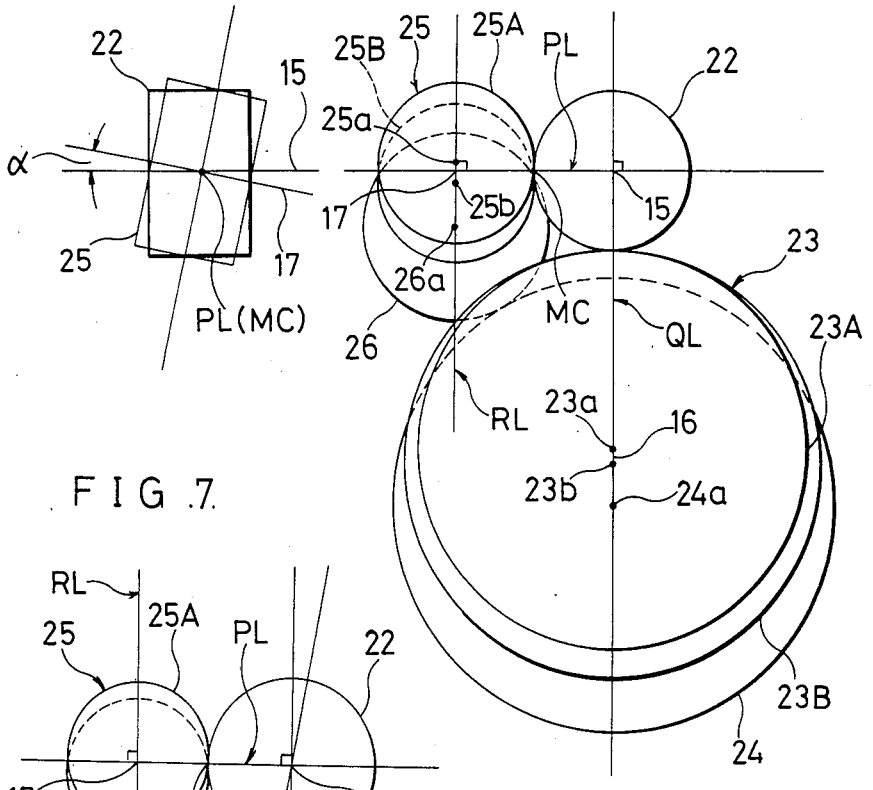
FIG. 5 a schematic view for explaining meshing of gears in the reversing gear assembly shown in FIG. 1.

Meshing of the cylindrical gears 22 and 25 on the input and intermediate shafts 15 and 17 is schematically illustrated in FIG. 5. With respect to the horizontal input shaft 15 and inclined intermediate shaft 17, there exists a sole line PL which is commonly perpendicular to these shafts. Center of engagement MC of the cylindrical gears 22 and 25 mounted on such two shafts is particularly located on the sole, common perpendicular line PL.

Arrangement of the gears 22–26 is schematically illustrated in the right half of FIG. 5 approximately in a front view. With respect to the third cylindrical gear 25 on the intermediate shaft 17, the foremost end profile 25A of such gear (having its center at **25*a*) and the rearmost end profile 25B (having its center at 25*b*) seen along the axial direction of the intermediate shaft 17 are illustrated. Similarly, with respect to the conical gear 23 on the output shaft 16, the foremost end profile 23A (having its center at 23*a*) and the rearmost end profile 23B (having its center at 23*b*) seen along the axial direction of the output shaft 16 are illustrated. Each of the fourth cylindrical gear 26 on the intermediate shaft 17 and second cylindrical gear 24 on the output shaft 16 is illustrated as a single circle (having its center at 26*a*, 24*a***, respectively) by taking a view along the axial direction of the intermediate or output shaft.

When the center of engagement MC of the cylindrical gears 22 and 25 is located on the common perpendicular line PL of the input shaft 15 and intermediate shaft 17, as described above, a straight line QL which includes thereon the center of the first cylindrical gear 22 (designated in FIG. 5 by numeral "15" for representing the input shaft) and the center of the conical gear 23 (designated in FIG. 5 by numeral "16" for representing the output shaft) becomes perpendicular to the common perpendicular line PL set forth before. That is, the conical gear 23 meshes with the first cylindrical gear 22 from a direction perpendicular to the common perpendicular line PL.

Figure 7:
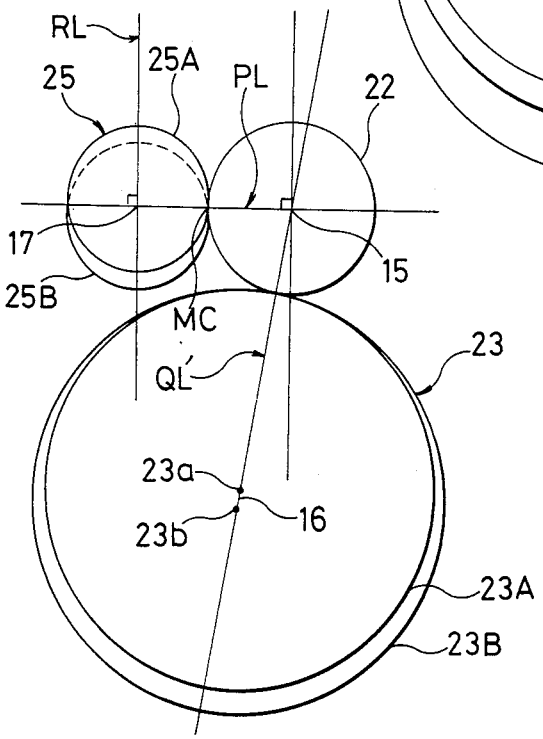
FIG. 7 is a schematic view similar to FIG. 5, but illustrating meshing of gears which is diffrent from the meshing of gears according to the present invention.

This will be explained by referring to FIG. 7. If the conical gear 23 meshes with the first cylindrical gear 22 from a direction oblique to the common perpendicular line PL, as shown in FIG. 7, then a straight line QL' which includes thereon the centers of gears 22 and 23 is not in parallel with a straight line RL which includes thereon the center of the third cylindrical gear 25 ( designated in FIG. 7 by numeral "17" for representing the intermediate shaft) and which is perpendicular to the common perpendicular line PL. Because each of the output shaft 16 and intermediate shaft 17 extends downwardly from the fore towards the aft, the level of such shafts 16 and 17 varies on and along the lines QL' and RL, respectively. It is thus seen that FIG. 7 depicts a non-parallel relationship between the output shaft 16 and intermediate shaft 17. In the gear assembly according to the present invention, the intermediate shaft 17 is arranged in parallel with the output shaft 16 so that the lines QL and RL are perpendicular to the line PL and are in parallel with each other, as depicted in FIG. 5.

Within the casing 14 a forward direction gear train is provided by the first cylindrical gear 22 and conical gear 23, whereas a reverse direction gear train is provided by the first, third, fourth and second cylindrical gears 22, 25, 26 and 24. The reverse direction gear train includes intermeshing cylindrical gears 26 and 24 mounted on the in-parallel disposed two shafts 17 and 16 so that gear or transmission ratio of such reverse direction gear train can be made equal to that of the forward direction gear train with ease. In the gear assembly shown, both of the gear trains are fashioned to have an equal gear ratio.

The reversing gear assembly according to the present invention can be used in a marine angle drive system by coupling the input shaft 15 or the fore end thereof to engine and by coupling the output shaft 16 or the aft end thereof to a propeller shaft, as shown in FIG. 6.

Forward drive of a boat is attained by coupling the conical gear 23 to the output shaft 16 using clutch 32. Power of the engine is transmitted from the input shaft 15 to the propeller shaft via the first cylindrical gear 22, conical gear 23, and output shaft 16. Reverse drive is attained by coupling the second cylindrical gear 24 to the output shaft 16 using clutch 32. In this case, power of the engine is transmitted from the input shaft 15 to the propeller shaft via the cylindrical gears 22, 25, 26 and 24 and via the output shaft 16. The propeller shaft is driven in either direction with substantially equal rotation speed and power.

Frequency and time of the reverse direction drive of a boat are very small. By taking this fact into consideration, the present invention employs for the reverse direction drive a transmission path which includes, between a horizotal input shaft 15 and an inclined intermediate shaft 17, meshing cylindrical gears 22 and 25 which have a center of engagement therebetween on the sole perpendicualr line of the horizontal and inclined shafts 15 and 17. In operation, torque is transmitted between these two gears 22 and 25 in a condition that teeth of these gears are deformed due to stress acting therebetween so that contact or engagement is caused which will spread the load over some axial length of the gears. Use of only one conical gear 23 is advantageous particularly because a precise adjustment of backlash has to be carried out with respect to only one such gear in assembling the reversing transmission. A conical gear is still high in manufacturing cost, as described before, so that use of only one conical gear is advantageous also in this respect.

The meshing cylindrical gears 26 and 24 on the in-parallel disposed intermediate and output shafts permits to choose or settle the gear ratio of the reverse direction gear train so as to match same with the gear ratio of the forward direction gear train. Consequently, the reversing gear assembly according to the present invention may be fashioned with ease such that the inclined output shaft 16 is driven in either direction with a substantially equal speed and power.

DESCRIPTION OF A PREFERRED EMBODIMENT

The reversing gear assembly 13 shown in FIGS. 1 to 5, intended for use in a pleasure boat shown in FIG. 6 referred to before, comprises a gear casing 14 to be attached to the rear end of an engine. The casing 14 shown has a fore end cover 14*a* which is also used as a mounting means for mounting the gear assembly on the rear of the engine.

Figure 2:
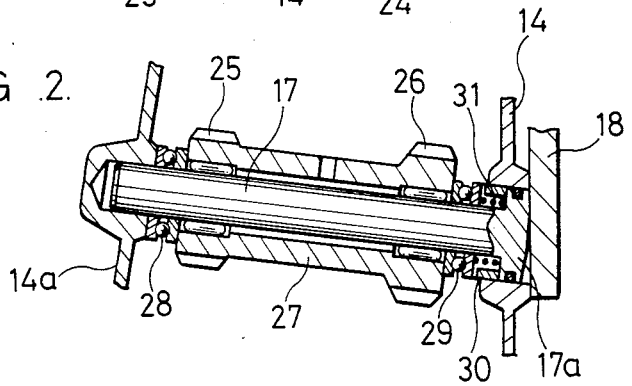
FIG. 2 is a sectional side view of a part of the reversing gear assembly shown in FIG. 1, illustrating a section different from that shown in FIG. 1.

As shown in FIGS. 1 to 4, the gear casing 14 supports therein an input shaft 15, an output shaft 16 and an intermediate shaft 17. Of these three shafts, the input shaft 15 and the output shaft 16 are journalled by the fore end cover 14*a* and the rear wall of casing 14 through bearings. The intermediate shaft 17 is fitted at both ends thereof into bores in the fore end cover 14*a* and the rear wall of casing 14 and is prevented from getting-out by a plate 18 attached to the rear surface of casing 14, as shown in FIG. 2. The input shaft 15 is arranged to extend horizontally, whereas the output shaft 16 is inclined backwardly and downwardly by an angle equal to the inclination angle of the propeller shaft 12 shown in FIG. 6. The intermediate shaft 17 is inclined by an angle (angle $\alpha$ shown in FIG. 5) equal to the inclination angle of the output shaft 16 so that the intermediate shaft extends parallel with the output shaft.

As shown in FIG. 1, the input shaft 15 extends forwardly from the gear casing 14 and is connected to the flywheel 19 of the engine through a damper coupling 20. The output shaft 16 extends backwardly from the casing 14 and has at its aft end portion a coupling half 21 for connection to the propeller shaft 12.

The input shaft 15 is formed at its fore end portion within the casing 14 integrally with a small cylindrical gear 22. On the output shaft 16 are rotatably mounted a large conical gear 23 and large cylindrical gear 24 which are spaced from each other in the fore and aft direction. The conical gear 23 on the backwardly and downwardly inclined output shaft 16 has teeth on a conical surface, converging to a point on the forward extension of the axis of output shaft 16, and meshes with the cylindrical gear 22 on the horizontal input shaft 15.

On the intermediate shaft 17 are rotatably mounted, as clearly shown in FIG. 2, a third cylindrical gear 25 and fourth cylindrical gear 26 which are spaced from each other in the fore and aft direction and are connected corotatably by a boss connection 27. Although the input shaft 15 and intermediate shaft 17 are inclined relative to each other by an angle of about 7 to 10 degrees to be given to the propeller shaft, the third cylindrical gear 25 on the intermediate shaft 17 meshes with the cylindrical gear 22 on the input shaft in the fashion having been detailed before by referring to FIG. 5. The rearwardly located fourth cylindrical gear 26 on the intermediate shaft 17 meshes with the cylindrical gear 24 on the output shaft 16.

Rotation of the meshing gears 22 and 25 on the shafts 15 and 17 which are inclined relative to each other will produce an axial thrust. A pair of thrust bearings 28 and 29 which sandwiches the integrally formed third and fourth cylindrical gears 25 and 26 are thus provided on the intermediate shaft 17, as shown in FIG. 2. On the shaft 17 is further disposed a ring 30 which is slightly spaced from the rewardly located bearing 29 and abuts on a diameter-enlarged end portion 17*a* of the intermediate shaft. Within this ring 30 and on the shaft 17 is disposed a compression coil spring 31 which is received at the ends thereof by the bearing 29 and shaft end portion 17*a*. As shown in FIG. 1, a clutch 32 is provided between the conical gear 23 and cylindrical gear 24 on the output shaft 16. This clutch 32 comprises a sliding double cone 34 which is slidably but non-rotatably mounted on the output shaft 16 by a helical spline connection 33. This cone 34 is formed with a pair of conical clutch surfaces 34*a* and 34*b* for selective engagement frictionally with respective conical clutch surfaces 23*a* and 24*a* formed in the conical and cylindrical gears 23 and 24. For avoiding an excessive torque transmission in each of the engaged conditions of the clutch 32, each of the gears 23 and 24 on the output shaft 16 is slidably supported, so that it may move slightly from the position shown in FIG. 1 towards a direction away from the cone 34, and is biased to the position shown by Belleville spring means 35, 36.

Figure 3:
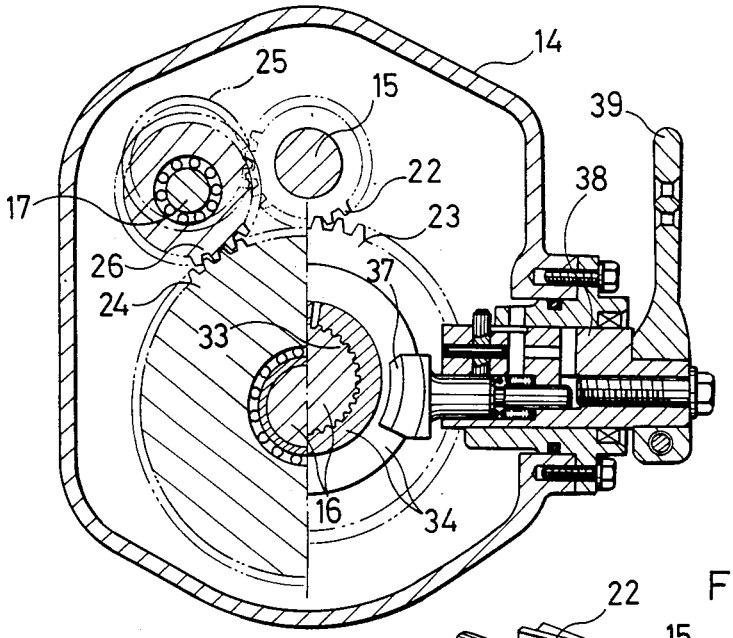
FIG. 3 is a sectional front view of the reversing gear assembly shown in FIG. 1, illustrating one and another sections.
Figure 4:
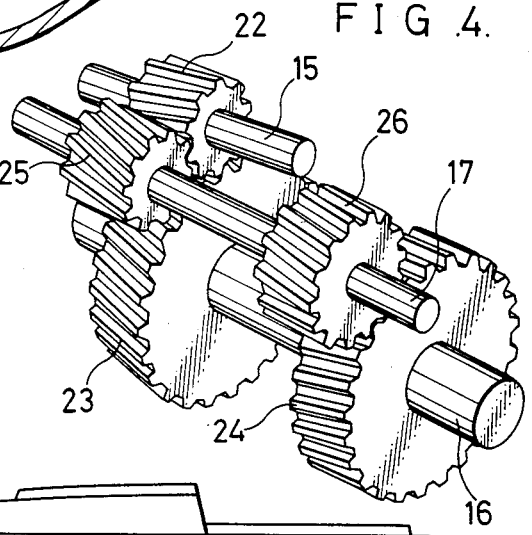
FIG. 4 is a a schematic perspective view, showing the arrangement of shafts and gears in the reversing gear assembly shown in FIG. 1; of gears in the reversing gear assembly shown in FIG. 1.

For shifting the cone 34 on the output shaft 16 selectively, a shifter 37 shown in FIG. 3 extends into an annular central groove formed to the cone 34 and engages such cone. This shifter 37 is supported by an angularly movable control shaft 38 at an eccentric position of such control shaft which extends through a side wall of the gear casing 14 and has a control lever 39 attached thereto outside the casing 14. The control lever 39 is operated to rotate by a remote control mechanism such as that, for example, disclosed in U.S. Pat. No. 4,278,156 selectively into a forward direction position, where the cone 34 is displaced forwards to cause frictional engagement between the clutch surfaces 23*a* and 34*a*, or into a reverse direction position where the cone 34 is displaced backwards to cause frictional engagement between the clutch surfaces 24*a* and 34*b*.

The reversing gear assembly 13 shown is to be employed in a boat in the fashion shown in FIG. 6. Forward direction drive and reverse direction drive of the boat are attained, respectively, by shifting the cone 34 on the output shaft 16 using the control lever 39 so as to couple selectively the conical gear 23 and the second cylindrical gear 24 to the output shaft 16. In either drive, rotation of the input shaft 15 is transmitted to the output shaft 16 and propeller shaft 12 with a reduction of rotation speed between gears 22 and 23 or between gears 26 and 24.

In the forward direction drive of boat, torque is transmitted between the cylindrical gear 22 on the input shaft 15 and the conical gear 23 on the output shaft 16 in a condition that teeth of these gears 22 and 23 are deformed due to stress acting therebetween so that contact or engagement is caused which will spread the load all over the axial length of such gears 22 and 23.

In the reverse direction drive of boat, torque is transmitted between the cylindrical gear 22 on the input shaft 15 and the cylindrical gear 25 on the intermediate shaft 17 in a condition that teeth of these gears are deformed due to stress acting therebetween so that contact or engagement is caused which will spread the load over some axial length of such gears 22 and 25. Although such transmission of torque is, of course, unfavorable with respect to efficiency of torque transmission and in view of a possible damage of transmission members due to a torsional deformation, the reverse direction drive of a boat, especially a pleasure boat, is carried out only for limited purposes, such as boat-stopping purpose at a harbor using the reverse direction drive for braking the boat, so that no substantial problem arises in practise. The cylindrical gears 25 and 26 on the intermediate shaft 17 are supported so that they are slightly movable under the biasing of compression spring 31. This supporting structure contributes to protect transmission members from a possible damage due to a torsional deformation.

We claim:

1. A marine reversing gear assembly for use in boats between an engine (11), mounted in a stern portion of the hull of a boat with the output end of the engine directed towards the stern, and a propeller shaft (12) extending backwardly and downwardly from the hull, the reversing gear assembly (13) comprising: a gear casing (14) in which are arranged a horizontal input shaft (15) extending forwardly from said casing, an inclined output shaft (16) extending backwardly and downwardly from said casing, and an intermediate shaft (17) disposed in parallel with said output shaft; a first cylindrical gear (22) fixedly mounted on said input shaft, axially spaced conical gear (23) and second cylindrical gear (24) rotatably mounted on said output shaft, said conical gear meshing with said first cylindrical gear, and axially spaced corotatable third cylindrical gear (25) having skewed teeth and fourth cylindrical gear (26) mounted on said intermediate shaft, said third cylindrical gear meshing with said first cylindrical gear such substantially line contact is attained at that a center of engagement between said first and third cylindrical gears located substantially on a common perpendicular line of said input and intermediate shafts, and said fourth cylindrical gear meshing with said second cylindrical gear; and a cone clutch means (32) disposed on said output shaft and between said conical gear and said second cylindrical gear for coupling one of the said gears selectively to said output shaft, said clutch means including a sliding double cone (34) which is mounted on said output shaft slidably but non-rotatably by a helical spline connection.

2. A marine reversing gear assembly according to claim 1, wherein gear ratio of a gear train comprising said first cylindrical gear (22) and said conical gear (23) is substantially equal to gear ratio of a gear train comprising said first, third, fourth and second cylindrical gears (22, 25, 26, 24).

3. A marine reversing gear assembly according to claim 1 or 2, wherein said third and fourth cylindrical gears (25, 26) are formed integrally with a boss connection (27) therebetween and are rotatably mounted on said intermediate shaft (17).

4. A marine reversing gear assembly according to claim 3, wherein thrust bearing means (28, 29) are provided between said third and fourth cylindrical gears (25, 26) and said gear casing (14).

* * * * *

UNITED STATES PATENT AND TRADEMARK OFFICE

CERTIFICATE OF CORRECTION

PATENT NO. : 4,748,864

DATED : June 7, 1988

INVENTOR(S) : Kazuhiko Ohusuki et al

It is certified that error appears in the above-identified patent and that said Letters Patent is hereby corrected as shown below:

Col. 8, line 5 change "such substantially line contact is attained at that" to --such that substantially line contact is attained at--.

Signed and Sealed this

Eleventh Day of October, 1988

*Attest:*

DONALD J. QUIGG

*Attesting Officer*

*Commissioner of Patents and Trademarks*